US008833754B2

(12) United States Patent
Inoue

(10) Patent No.: US 8,833,754 B2
(45) Date of Patent: Sep. 16, 2014

(54) SHEET FEEDING APPARATUS AND IMAGE FORMING APPARATUS

(71) Applicant: Canon Kabushiki Kaisha, Tokyo (JP)

(72) Inventor: Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/650,407

(22) Filed: Oct. 12, 2012

(65) Prior Publication Data

US 2013/0106044 A1 May 2, 2013

(30) Foreign Application Priority Data

Nov. 1, 2011 (JP) ..... 2011-240474

(51) Int. Cl.

| | |
|---|---|
| ***B65H 1/08*** | (2006.01) |
| ***B65H 3/48*** | (2006.01) |
| ***B65H 3/54*** | (2006.01) |
| ***B65H 3/08*** | (2006.01) |
| ***B65H 1/14*** | (2006.01) |
| ***B65H 7/04*** | (2006.01) |

(52) U.S. Cl.

CPC ..... *B65H 1/14* (2013.01); *B65H 2553/60* (2013.01); *B65H 3/48* (2013.01); *B65H 2801/06* (2013.01); *B65H 3/54* (2013.01); *B65H 3/0816* (2013.01); *B65H 2405/15* (2013.01); *B65H 2511/515* (2013.01); *B65H 2513/41* (2013.01); *B65H 7/04* (2013.01)

USPC ..... 271/30.1; 271/169; 271/171; 271/31

(58) Field of Classification Search

USPC ..... 271/171, 30.1, 31, 38, 147, 169, 170

See application file for complete search history.

(56) References Cited

U.S. PATENT DOCUMENTS

| | | | | |
|---|---|---|---|---|
| 5,050,854 | A * | 9/1991 | Tajima | 271/122 |
| 5,344,133 | A * | 9/1994 | Jantsch et al. | 271/94 |
| 5,358,230 | A | 10/1994 | Ikemori et al. | |
| 5,485,991 | A | 1/1996 | Hirano et al. | |
| 5,793,399 | A | 8/1998 | Kawakami et al. | |
| 5,876,030 | A * | 3/1999 | Dobbertin et al. | 271/13 |
| 5,893,554 | A * | 4/1999 | Okahashi et al. | 271/98 |
| 5,899,451 | A | 5/1999 | Kiyohara et al. | |
| 6,015,144 | A * | 1/2000 | Yoshii et al. | 271/97 |
| 6,045,220 | A | 4/2000 | Kiyohara et al. | |
| 6,131,899 | A | 10/2000 | Nojima et al. | |
| 6,200,043 | B1 | 3/2001 | Inoue et al. | |
| 7,540,489 | B2 * | 6/2009 | Kushida | 271/98 |
| 7,588,244 | B2 * | 9/2009 | Kawamoto et al. | 271/31 |
| 7,635,129 | B2 * | 12/2009 | Inoue | 271/258.01 |

(Continued)

FOREIGN PATENT DOCUMENTS

EP 2213599 A2 8/2010

*Primary Examiner* — Ernesto Suarez

(74) *Attorney, Agent, or Firm* — Fitzpatrick, Cella, Harper & Scinto

(57) ABSTRACT

A sheet feeding apparatus capable of reliably feeding a sheet even when a gap is formed between the sheet and a regulating portion, and an image forming apparatus are provided. A tail end regulating plate 13 regulates a movement of a sheet supported by a tray supporting the sheet so as to be lifted or lowered, and when a gap is formed between the tail end regulating plate 13 and the sheet supported by the tray, tail end regulating projections 18H and 18I which are provided so as to protrude to the gap regulate the movement of the sheet toward the tail end regulating plate 13.

14 Claims, 14 Drawing Sheets

(56) References Cited

U.S. PATENT DOCUMENTS

| | | | | |
|---|---|---|---|---|
| 7,677,553 | B2 * | 3/2010 | Ikeda | 271/98 |
| 7,918,448 | B2 * | 4/2011 | Suzuki et al. | 271/171 |
| 8,292,293 | B2 | 10/2012 | Inoue | |
| 2006/0012107 | A1 * | 1/2006 | Ueda et al. | 271/98 |
| 2010/0090392 | A1 * | 4/2010 | Ikeda | 271/109 |
| 2010/0194031 | A1 | 8/2010 | Ikeda et al. | |
| 2013/0020759 | A1 | 1/2013 | Inoue | |
| 2013/0026706 | A1 | 1/2013 | Hirota et al. | |

* cited by examiner

SHEET FEEDING APPARATUS AND IMAGE FORMING APPARATUS

BACKGROUND OF THE INVENTION

1 Field of the Invention

The present invention relates to a sheet feeding apparatus and an image forming apparatus, and particularly, to a configuration of a regulating portion that regulates a movement of a sheet.

2. Description of the Related Art

Hitherto, many sheet feeding apparatuses that adopt various sheet feeding techniques such as an air sheet feeding technique or a retarding roller sheet feeding technique have been proposed. Recently, in such sheet feeding apparatuses, there has been a demand for a sheet feeding apparatus that includes a large capacity of an accommodation deck and continuously supplies many sheets to an image forming portion.

As such a sheet feeding apparatus, there is known a sheet feeding apparatus employing an air sheet feeding technique. The sheet feeding apparatus includes a large capacity of an accommodation deck and feeds sheets accommodated in the accommodation deck by air (see U.S. Patent Application Publication No. 2010/0194031 A1). Then, in the sheet feeding apparatus, for example, an air sheet feeding type sheet feeding portion 400 is disposed above an accommodation deck (not illustrated) accommodating the sheets as illustrated in FIGS. 14A and 14B. Then, the sheet feeding portion 400 includes an absorption conveying belt 21, an absorption duct 51 disposed inside the absorption conveying belt 21, and an absorption fan (not illustrated) which allows the inside of the absorption duct 51 to have a negative pressure.

The accommodation deck is equipped with a lifting and lowering platen 12 which places a plurality of sheets S thereon and is lifted or lowered and a tail end regulating plate 13 which regulates the tail end positions of the plurality of placed sheets S. Further, a loosening nozzle 33 and a separating nozzle 34, which are provided on the downstream of the accommodation deck in the sheet feeding direction so as to blow air from the leading ends of the sheets S, are provided so as to loosen or separate the sheets S while being blown up. Then, the loosening nozzle 33 and the separating nozzle 34 are connected with an air supply unit 401 with a loosening and separating fan (not illustrated), and air is supplied to the loosening nozzle 33 and the separating nozzle 34 by the air supply unit 401.

Next, a sheet feeding operation of the sheet feeding portion 400 of the related art will be described. When the sheet feeding operation starts, the lifting and lowering platen 12 having the sheets S placed thereon starts to be lifted until the uppermost sheet Sa of the plurality of placed sheets S reaches a predetermined position around the opening of the loosening nozzle 33 illustrated in FIG. 14A. Subsequently, when a sheet feeding instruction is received, the separating fan of the air supply unit 401 starts to rotate.

Accordingly, loosening air and separating air start to blow from the loosening nozzle 33 and the separating nozzle 34 as indicated by the arrows a and b toward the side end of the upper portion of the plurality of stacked sheets S. Here, the backward movement of the sheet S is regulated by the tail end regulating plate 13. Accordingly, when air blows, the blowing air enters between the sheets S, so that the upper portion of the stacked sheets S is blown up so as to loosen the sheets S.

On the other hand, at the time point at which the sheet feeding instruction is received, the absorption fan starts to rotate, and hence the inside of the absorption duct 51 becomes a negative pressure state. For this reason, when an absorption shutter (not illustrated) provided inside the absorption duct 51 is opened, the uppermost sheet Sa is absorbed onto the absorption conveying belt 21. Furthermore, at this time, it is possible to reliably separate the uppermost sheet Sa and the lower sheet from each other by the effect of the separating air flow formed below the absorption conveying belt 21 by the separating nozzle 34.

Subsequently, the absorption conveying belt 21 rotates according to an image forming timing of an image forming portion (not illustrated), and the uppermost sheet Sa is delivered to a pair of drawing rollers (not illustrated) disposed at the downstream of the absorption conveying belt 21 in the sheet feeding direction, thereby completing the feeding of the uppermost sheet Sa. Furthermore, at the time point at which the sheet Sa is delivered to the pair of drawing rollers, the absorption shutter is closed and the inside of the absorption duct 51 becomes a negative pressure state, thereby preparing the next sheet feeding operation. Hereinafter, this operation is repeated.

Here, in the sheet feeding apparatus including a large capacity of the accommodation deck, the tail end regulating plate as the regulating portion which regulates the movement of the sheet is generally provided so as to be movable to the tail end regulating position in response to the size of the sheet. Then, when the sheets are placed on the lifting and lowering platen, the tail end regulating plate is moved and set so as to match the tail ends of the placed sheets. Further, the accommodation deck is equipped with a side end regulating plate as a regulating portion which regulates the position of the sheet in the width direction perpendicular to the sheet feeding direction, and when the sheet is placed on the lifting and lowering platen, the side end regulating plate is also moved and set so as to match the side ends of the placed sheets.

However, for example, when moving the tail end regulating plate, a gap may be formed between the tail end regulating plate and the sheet when the movement of the tail end regulating plate is not sufficient or the tail end regulating plate is set while the sheet is not placed on a lifting and lowering platen in a straight way. Then, when air blows to the sheets while the gap is formed between the sheet and the tail end regulating plate in this way, the sheet S which is blown up by the air is retracted in the direction opposite to the sheet feeding direction by the gap between the sheet and the tail end regulating plate 13 as illustrated in FIG. 14B.

As a result, the balance between the separating air, the loosening air, and each air flow from the absorption duct collapses, so that the sheet S is unstably blown up. Accordingly, the sheet may not be normally absorbed onto the absorption conveying belt 21 or a plurality of sheets may be absorbed onto the absorption conveying belt 21. In this case, a problem arises in which a feeding failure occurs in the sheet S or a double feeding occurs in the sheet S.

Furthermore, this problem arises not only in a sheet feeding apparatus employing the air sheet feeding technique, but also a retarding roller type sheet feeding apparatus which returns double-fed sheets toward the tail end regulating plate by a retarding roller. That is, even in a case of the retarding roller type sheet feeding apparatus, when a gap is formed between the sheet and the tail end regulating plate, the sheet which is returned by the retarding roller may be retracted by the gap between the tail end regulating plate and the sheet. Then, in such a case, a feeding failure may occur in the sheet.

Therefore, the invention is made in view of such circumstances, and it is desirable to provide a sheet feeding apparatus capable of reliably feeding a sheet even when a gap is formed between the sheet and a regulating portion, and an image forming apparatus.

SUMMARY OF THE INVENTION

According to an aspect of the invention, there is provided a sheet feeding apparatus including: a tray which supports a sheet; a sheet feeding portion, provided above the tray, configured to feed the sheet supported by the tray; a regulating portion which regulates a movement of the sheet supported by the tray; and a stopper which is positioned in a gap so as to regulate the movement of the sheet toward the regulating portion when the gap is formed between the regulating portion and the sheet supported by the tray.

As in the aspect of the invention, since the movement of the sheet toward the regulating portion is regulated by the stopper which protrudes toward the gap formed between the sheet and the regulating portion, the sheet can be reliably fed even when a gap is formed between the sheet and the regulating portion.

Further features of the present invention will become apparent from the following description of exemplary embodiments with reference to the attached drawings.

DESCRIPTION OF THE EMBODIMENTS

Figure 1:
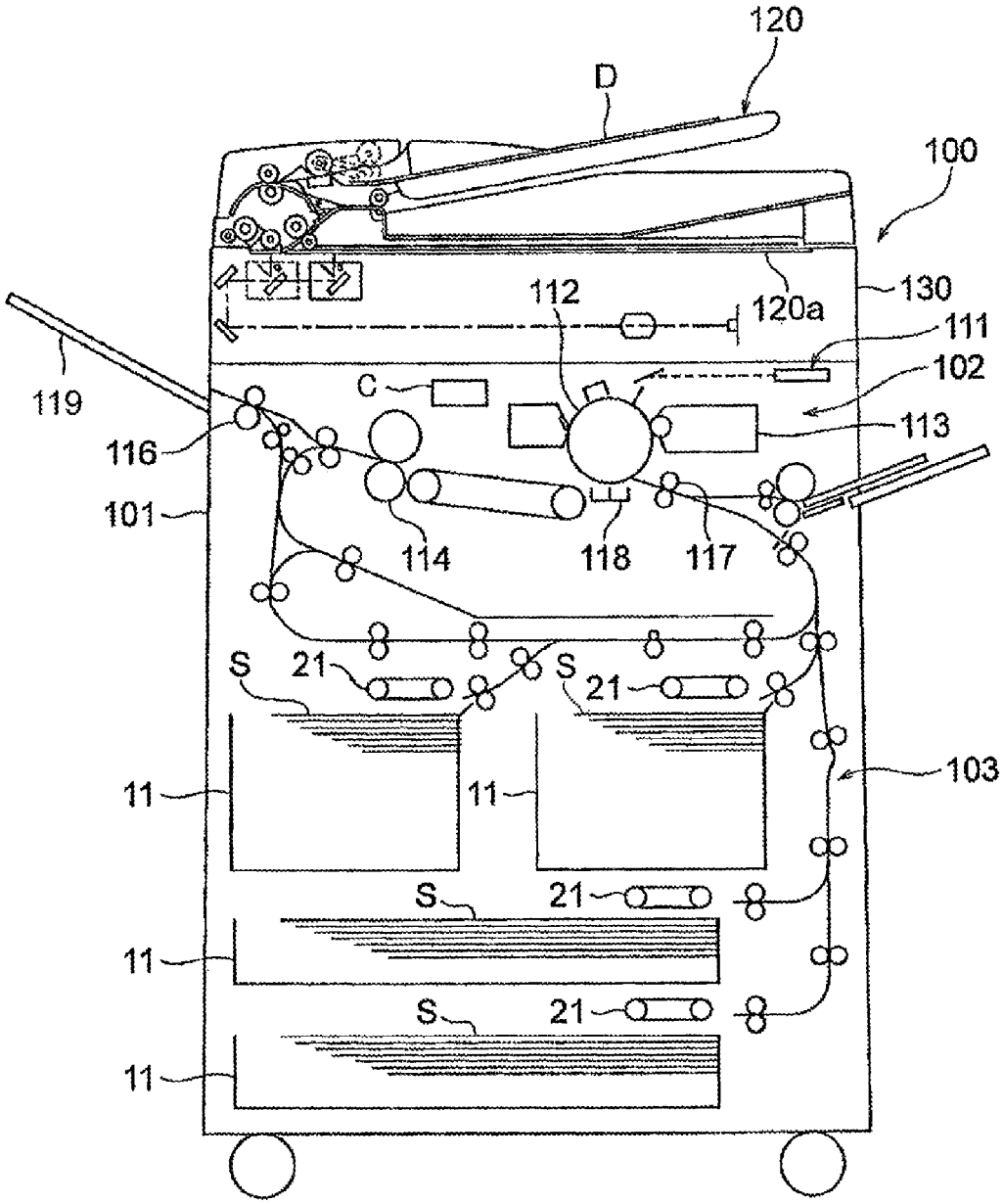
FIG. 1 is a diagram illustrating a schematic configuration of a printer which is an example of an image forming apparatus having a sheet feeding apparatus according to a first embodiment of the invention.

Hereinafter, exemplary embodiments of the invention will be described in detail by referring to the drawings. FIG. 1 is a diagram illustrating a schematic configuration of a printer which is an example of an image forming apparatus having a sheet feeding apparatus according to a first embodiment of the invention.

In FIG. 1, a printer 100 and a printer body 101 are provided. The upper portion of the printer body 101 is equipped with an image reading portion 130 that reads an original D which is placed on a platen glass 120*a* as an original placing platen by an automatic original feeding unit 120. Further, an image forming portion 102 and a sheet feeding apparatus 103 feeding a sheet S to the image forming portion 102 are provided below the image reading portion 130.

Here, the image forming portion 102 is equipped with a photosensitive drum 112, a development device 113, a laser scanner unit 111, and the like. Further, the sheet feeding apparatus 103 includes a plurality of sheet accommodating portions 11 which accommodates a sheet S such as an OHT and are attachable to or detachable from the printer body 101, an absorption conveying belt 21 which sends the sheets S accommodated in the sheet accommodating portion 11, and the like.

Next, an image forming operation of the printer 100 with such a configuration will be described. When an image reading signal is output from a controller C provided in the printer body 101 and illustrated in FIG. 3 as described later to the image reading portion 130, the image of the original D is read by the image reading portion 130. Subsequently, a laser beam corresponding to the electric signal is irradiated from the laser scanner unit 111 onto the photosensitive drum 112. At this time, the photosensitive drum 112 is charged in advance, is irradiated with light so as to form an electrostatic latent image on the drum, and then an electrostatic latent image is developed by the development device 113, thereby forming a toner image on the photosensitive drum.

On the other hand, when a sheet feeding signal is output from the controller to the sheet feeding apparatus 103, the sheet S is fed from the sheet accommodating portion 11. Subsequently, the fed sheet S is sent to a transfer portion including the photosensitive drum 112 and a transfer charger 118 so as to match the toner image on the photosensitive drum by a registration roller 117. Next, the toner image is transferred onto the sheet which is sent to the transfer portion in this way, and the sheet is conveyed to a fixing portion 114. Subsequently, the sheet is heated and pressurized by the fixing portion 114, so that an unfixed image is permanently fixed to the sheet S. Then, the sheet having an image formed thereon in this way is discharged by a discharge roller 116 from the printer body 101 to a discharge tray 119.

Figure 2:
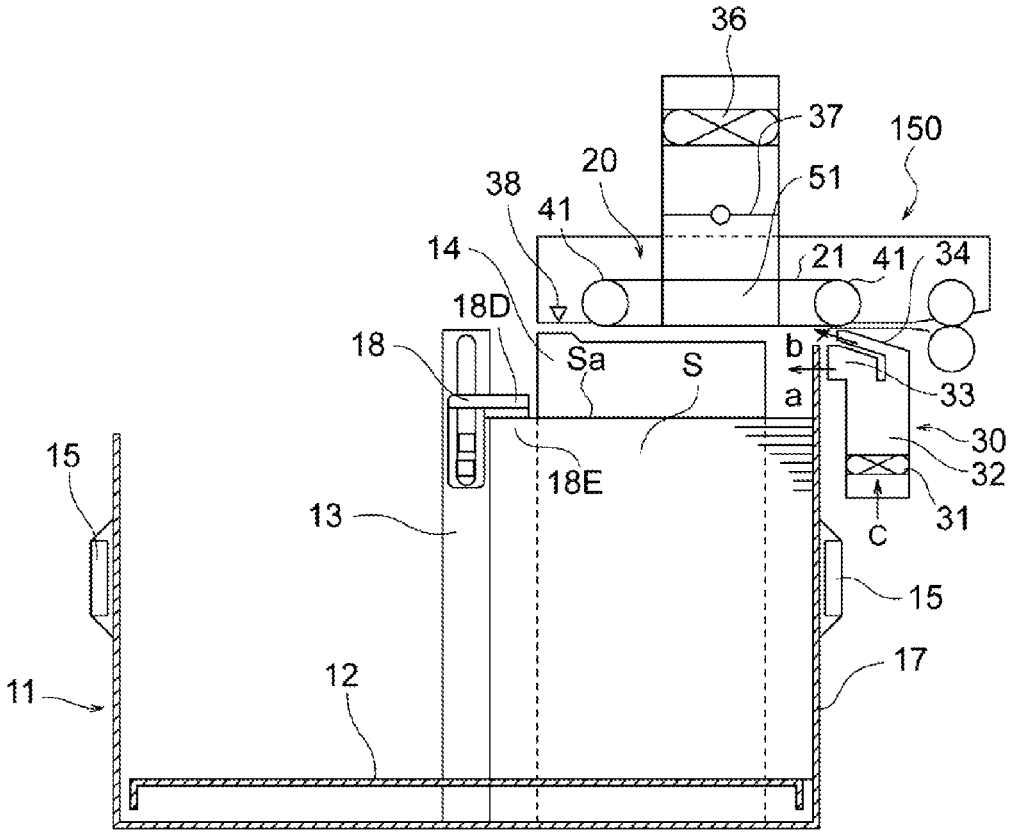
FIG. 2 is a diagram illustrating a configuration of the sheet feeding apparatus.

FIG. 2 is a diagram illustrating a configuration of the sheet feeding apparatus 103. Each sheet accommodating portion 11 includes a lifting and lowering platen 12 which is an elevatable tray, a tail end regulating plate 13 which regulates the position of the tail end as the upstream end of the sheet S in the sheet feeding direction, a leading end regulating plate 17, and a side end regulating plate 14 which regulates the position of the sheet S in the width direction perpendicular to the sheet feeding direction. Furthermore, the tail end regulating plate 13 and the side end regulating plate 14 as the regulating portions which regulate the movement of the sheet stacked and supported by the lifting and lowering platen 12 are configured to arbitrarily change the position according to the size of the accommodated sheet. Further, the tail end regulating plate 13 is equipped with a tail end upper face regulating portion 18 which is movable in the vertical direction so as to regulate the height position of the tail end as the upstream end of the uppermost sheet Sa in the sheet feeding direction.

The sheet accommodating portion 11 may be drawn out from the printer body 101 by a slide rail 15, and when the sheet accommodating portion 11 is drawn out from the printer body, the sheet may be replenished or replaced by lowering the lifting and lowering platen 12 to a predetermined position. Furthermore, the lifting and lowering platen 12 is elevated by a lifter mechanism (not illustrated) having a lifter driving motor such as a stepping motor or a DC servo motor.

Further, the upper portion of the sheet accommodating portion 11 is equipped with an air sheet feeding type sheet feeding portion (hereinafter, referred to as an air sheet feeding portion 150) which feeds each of the sheets in a separated state. The air sheet feeding portion 150 includes an absorption conveying portion 20 which absorbs and conveys the sheet S stacked on the lifting and lowering platen 12 and an air blowing portion 30 which loosens the sheets S by lifting the upper portion of the plurality of sheets S on the lifting and lowering platen and separates each of the sheet S.

Here, the absorption conveying portion 20 includes an absorption conveying belt 21 which is hung over a belt driving roller 41 and feeds the sheets S to the right side in the drawing in an absorbed state and an absorption fan 36 which generates a negative pressure for causing the sheet S to be absorbed to the absorption conveying belt 21. Further, the absorption conveying portion includes an absorption duct 51 which is disposed at the inside of the absorption conveying belt 21 and suctions air through a suction hole (not illustrated) formed in the absorption conveying belt 21. In addition, the absorption conveying portion includes an absorption shutter 37 which is disposed between the absorption fan 36 and the absorption duct 51 and turns on or off the absorption operation of the absorption conveying belt 21. Furthermore, in the embodiment, a plurality of absorption conveying belts 21 is arranged at a predetermined interval in the width direction.

Further, the air blowing portion 30 includes a loosening nozzle 33 and a separating nozzle 34 which blow air to the front upper side of the accommodated sheet S, a loosening and separating fan 31, and a separating duct 32 which sends air from the loosening and separating fan 31 to the respective nozzles 33 and 34. Then, a part of the air which blows in the direction of arrow c by the loosening and separating fan 31 passes through the separating duct 32, and blows in the direction of the arrow a by the loosening nozzle 33, so that several sheets at the upper portion of the sheets S stacked on the lifting and lowering platen 12 are blown up. Further, the other air blows in the direction of the arrow b by the separating nozzle 34, and each of the sheets lifted by the loosening nozzle 33 is separated, so that the sheet is absorbed onto the absorption conveying belt 21.

Figure 3:
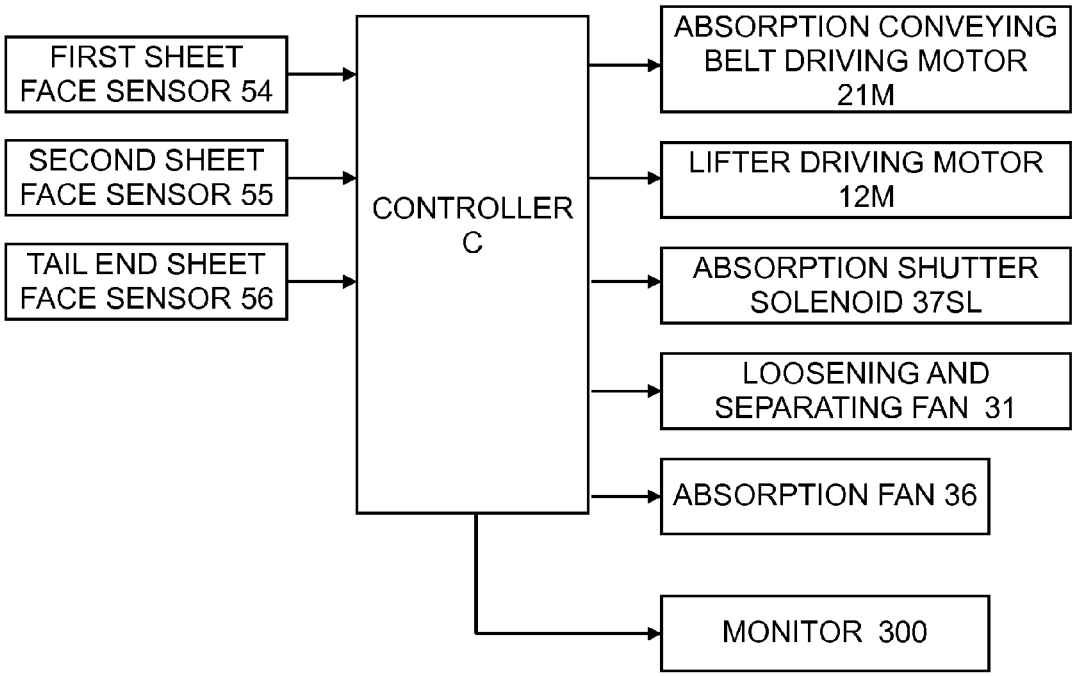
FIG. 3 is a control block diagram illustrating the sheet feeding apparatus.

Furthermore, FIG. 3 is a control block diagram illustrating the sheet feeding apparatus 103. The controller C is connected with first and second sheet face sensors 54 and 55 which are provided in a sheet face detecting mechanism illustrated in FIG. 5 and a tail end sheet face sensor 56 which detects the tail end face of the sheet. Further, the controller C is connected with an absorption conveying belt driving motor 21M which drives the absorption conveying belt 21, a lifter driving motor 12M which lifts and lowers the lifting and lowering platen 12, and an absorption shutter solenoid 37SL which rotates the absorption shutter 37. Further, the controller C is connected with an absorption fan 36 which generates a negative pressure for absorbing the sheet onto the absorption conveying belt 21, the loosening and separating fan 31 which blows air to the sheet, and a monitor 300.

Next, a sheet feeding operation of the sheet feeding apparatus 103 (the air sheet feeding portion 150) structured as described above will be described. First, when a user extracts the sheet accommodating portion 11, sets the sheets S thereon, and then accommodates the sheet accommodating portion 11 at a predetermined position, the lifter driving motor 12M is first driven. Accordingly, when the lifting and lowering platen 12 is lifted and reaches a position where the distance between the stacked and supported sheet and the absorption conveying belt 21 becomes a distance in which the sheet may be fed, the controller C stops the lifting and lowering platen 12 at the position. Subsequently, a sheet feeding signal for starting the feeding is prepared.

Figure 4A:
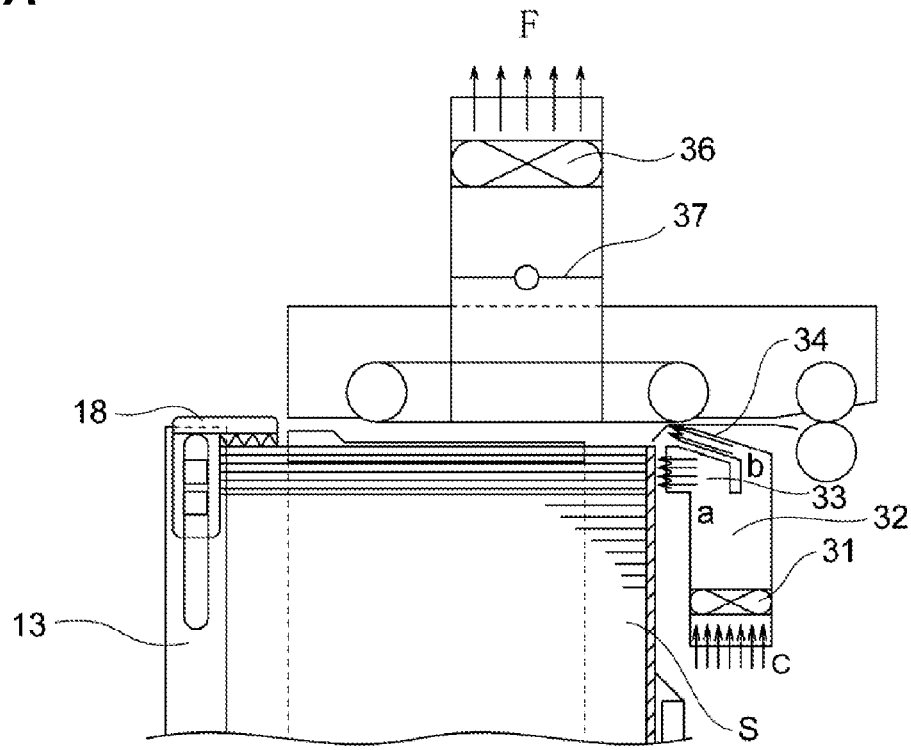
FIGS. 4A and 4B are diagrams illustrating a sheet feeding operation of the sheet feeding apparatus.

Next, when the sheet feeding signal is detected, the controller C suctions air in the direction of the arrow c as illustrated in FIG. 4A by operating the loosening and separating fan 31. The air blows from the loosening nozzle 33 and the separating nozzle 34 in the directions of the arrows a and b to the sheet through the separating duct 32. Accordingly, several sheets at the upper portion in the plurality of sheets S are blown up. Further, the controller C discharges air in the direction F of the drawing by operating the absorption fan 36. At this time, the absorption shutter 37 is still closed.

Figure 4B:
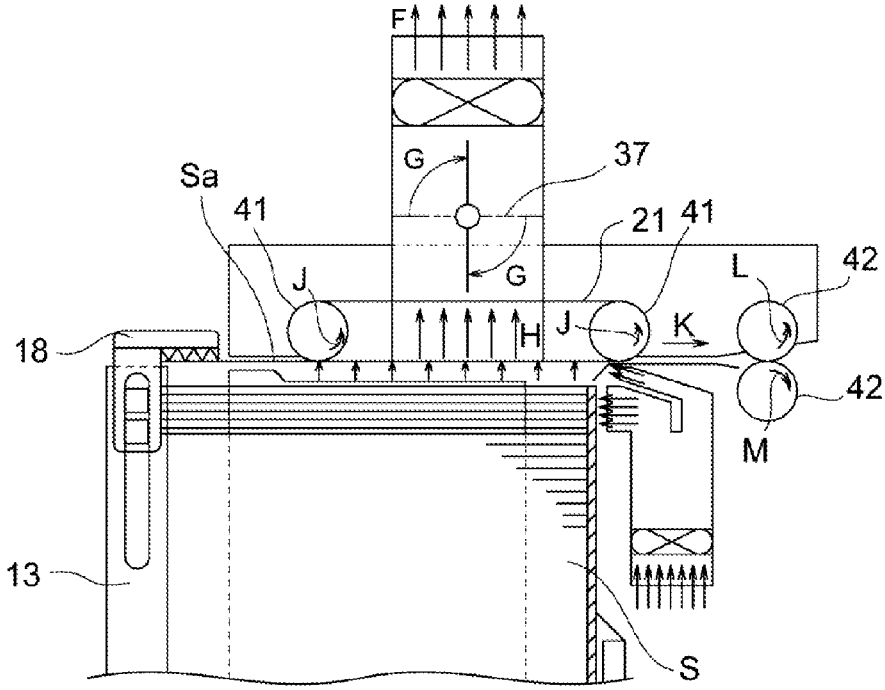

Next, when a predetermined time elapses from the timing of detecting the sheet feeding signal and the upward blowing of the upper sheet is stabilized, the controller C rotates the absorption shutter 37 in the direction of the arrow G as illustrated in FIG. 4B by driving the absorption shutter solenoid 37SL. Accordingly, air is suctioned in the direction of the arrow H from the suction hole provided in the absorption conveying belt 21, whereby a suction force is generated. Then, only the uppermost sheet Sa is absorbed onto the absorption conveying belt 21 by the absorption force and the separating air from the separating nozzle 34.

Subsequently, the controller C rotates the belt driving roller 41 in the direction of the arrow J by driving the absorption conveying belt driving motor 21M illustrated in FIG. 3. Accordingly, the uppermost sheet Sa which is absorbed onto the absorption conveying belt 21 is fed in the direction of the arrow K, and the sheet Sa is sent toward the image forming portion by a pair of drawing rollers 42 which rotates in the directions of the arrows L and M.

Figure 5:
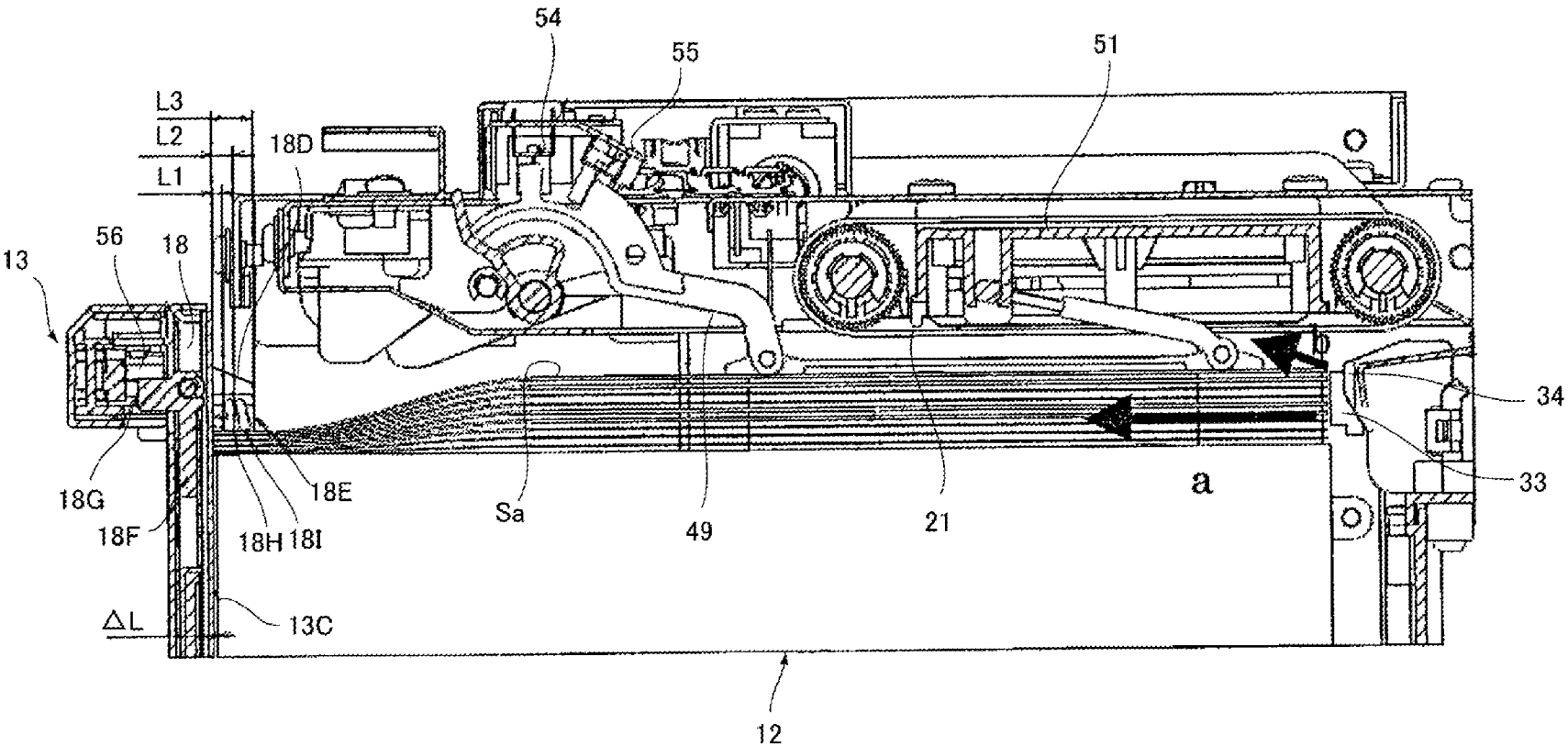
FIG. 5 is a diagram illustrating an air sheet feeding portion of the sheet feeding apparatus.

Furthermore, as illustrated in FIG. 5, the sheet feeding apparatus 103 is equipped with a sheet face detecting mechanism 49 which abuts the upper face of the sheet S so as to detect the upper face of the sheet S placed on the lifting and lowering platen 12 and two sheet face sensors 54 and 55 which detect the height of the sheet face detecting mechanism 49. Further, the tail end regulating plate 13 is equipped with the tail end upper face regulating portion 18 which regulates the upward blowing of the tail end of the sheet by abutting the upper face of the tail end of the sheet S placed on the lifting and lowering platen 12 and the tail end sheet face sensor 56 which detects the height position of the sheet by detecting the position of the tail end upper face regulating portion 18.

Figure 6:
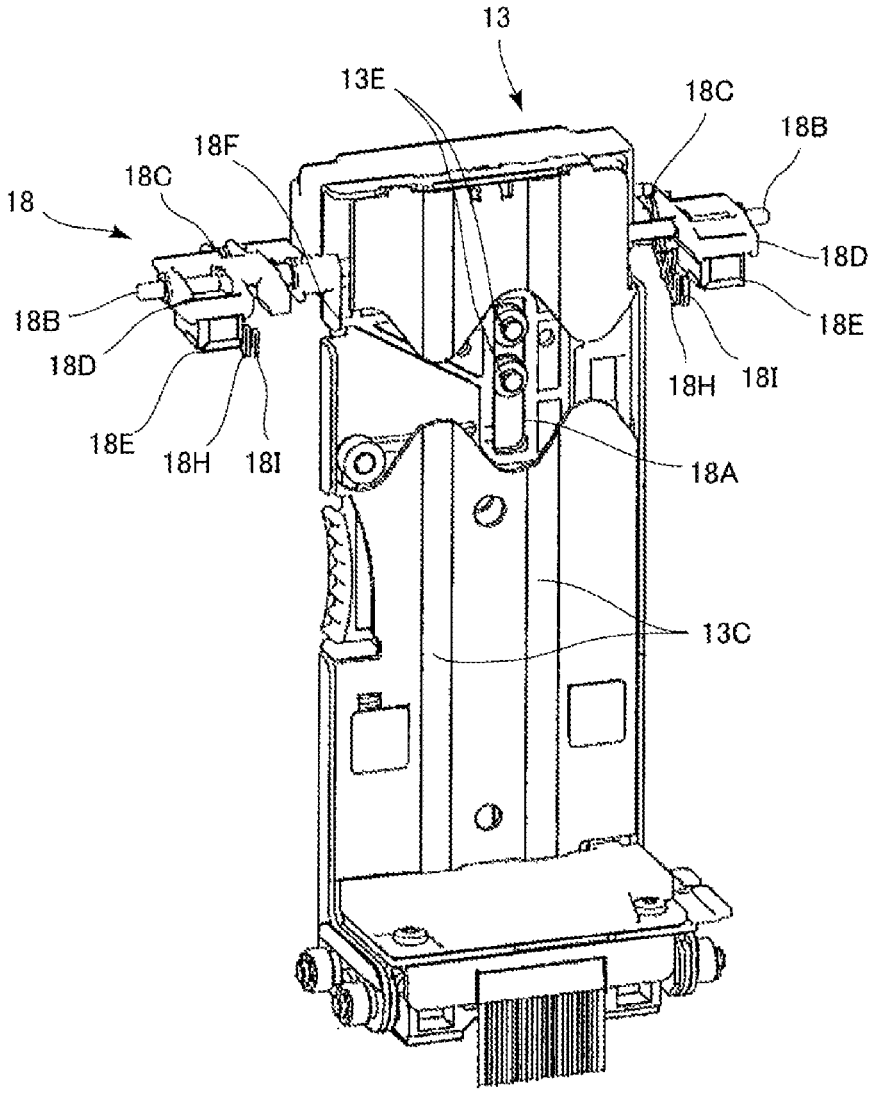
FIG. 6 is a diagram illustrating a configuration of a tail end regulating plate of the sheet feeding apparatus.

Here, as illustrated in FIG. 6, the tail end upper face regulating portion 18 is equipped with an engagement portion 18A which engages with a support portion 13E of the tail end regulating plate 13. Accordingly, the tail end upper face regulating portion 18 may be lifted and lowered integrally with the sheet while abutting the upper portion of the sheets stacked on the lifting and lowering platen 12 along the tail end regulating plate 13. Furthermore, it is desirable that the support portion 13E is equipped with a ball bearing or a roller having a low surface friction resistance so as to smoothly perform the lifting and lowering operation. Further, in the uppermost portion of the tail end upper face regulating portion 18, a protrusion portion 18D which protrudes from the tail end regulating surface 13C of the tail end regulating plate 13 toward the leading end regulating plate (the lifting and lowering platen) is supported by a support shaft 18B so as to be rotatable upward. Then, the protrusion portion 18D generally abuts the uppermost sheet and abuts the surface of the lifting and lowering platen 12 when no sheet is present. Further, a tail end regulating pad 18E is attached to a bottom surface as a sheet contact surface of the protrusion portion 18D.

In addition, the tail end upper face regulating portion 18 includes a slider 18F which holds the protrusion portion 18D and the tail end regulating pad 18E and is slidable in the vertical direction. Here, the slider 18F is equipped with a tail end sheet face detecting sensor flag 18G which turns on or off the tail end sheet face sensor 56 as illustrated in FIG. 5. Accordingly, the tail end upper face regulating portion 18 can reliably follow the movement of the uppermost sheet, and hence the tail end sheet face sensor 56 can detect the height of the sheet based on the position of the tail end upper face regulating portion 18.

Figure 7:
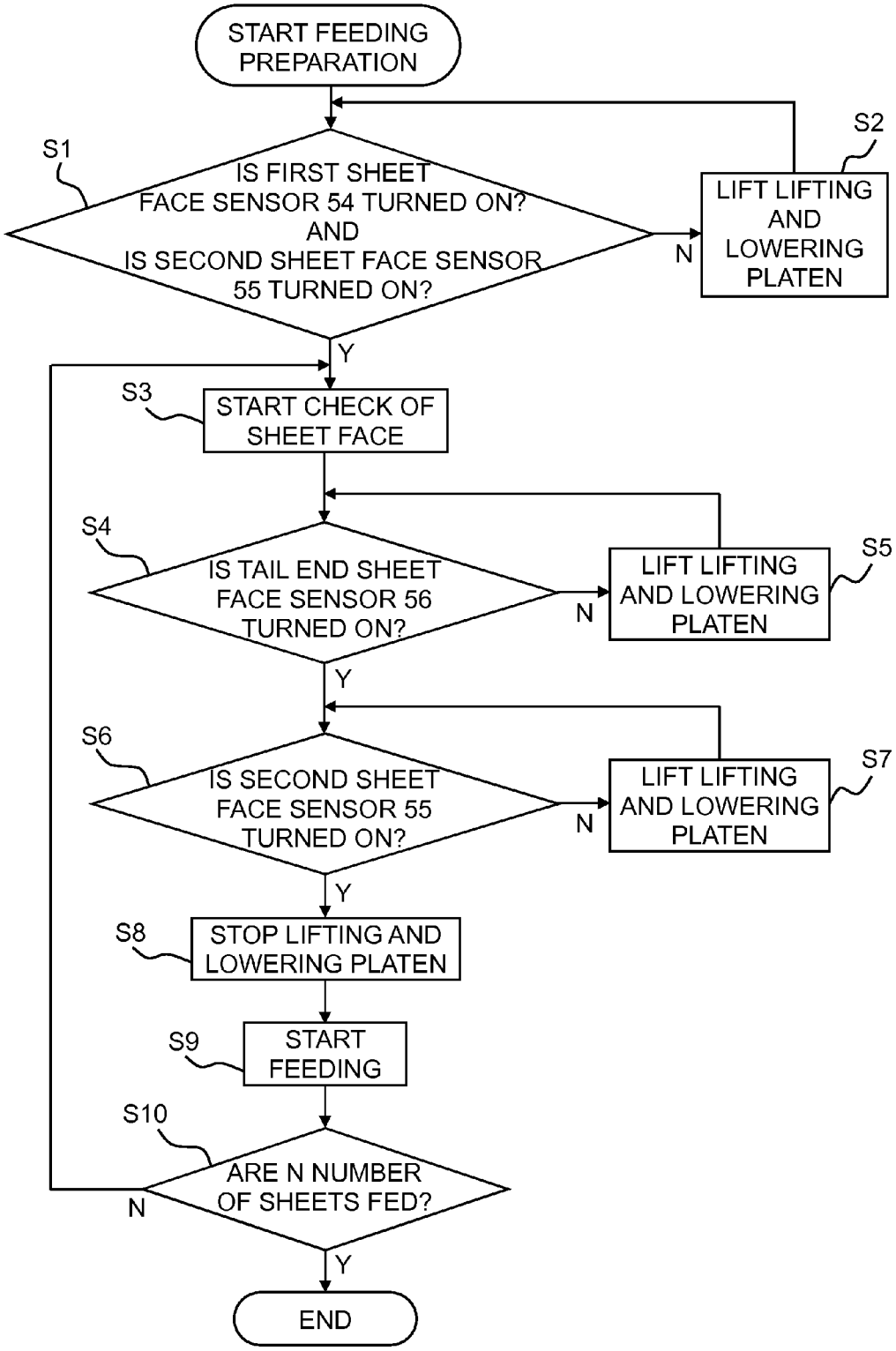
FIG. 7 is a flowchart illustrating a lifting and lowering control of a lifting and lowering platen of the sheet feeding apparatus.

Next, a lifting and lowering control of the lifting and lowering platen 12 when feeding the sheet according to the embodiment will be described by using the flowchart illustrated in FIG. 7. When the controller C receives the sheet feeding signal, the controller starts the feeding preparation. The controller C first starts the rotation of the loosening and separating fan 31 and starts the blowing of air so that the sheet is blown up. Subsequently, when the first and second sheet face sensors 54 and 55 are not turned on (N in S1), the lifting and lowering platen 12 is lifted (S2). When the first and second sheet face sensors 54 and 55 are turned on (Y in S1), the check of the sheet face by the tail end sheet face sensor 56 starts (S3).

Then, when the tail end sheet face sensor 56 is not turned on (N in S4), the lifting and lowering platen 12 is lifted (S5). Subsequently, when the tail end sheet face sensor 56 is turned on (Y in S4), it is determined whether the position of the uppermost sheet is present in an appropriate range based on the signal of the second sheet face sensor 55. Then, when the second sheet face sensor 55 is not turned on (N in S6), the lifting and lowering platen 12 is lifted (S7) until the second sheet face sensor 55 is turned on (Y in S6).

Next, when the second sheet face sensor 55 is turned on (Y in S6), that is, when the lifting and lowering platen 12 is lifted to a position where the feeding is possible, the lifting and lowering platen 12 is stopped (S8), and the feeding of the sheet starts (S9). Furthermore, such a control is repeated until the N-th sheet is fed when N number of sheets are stacked (supported) on the lifting and lowering platen 12, and the feeding operation ends when the N-th sheet is fed (Y in S10).

Figure 8A:
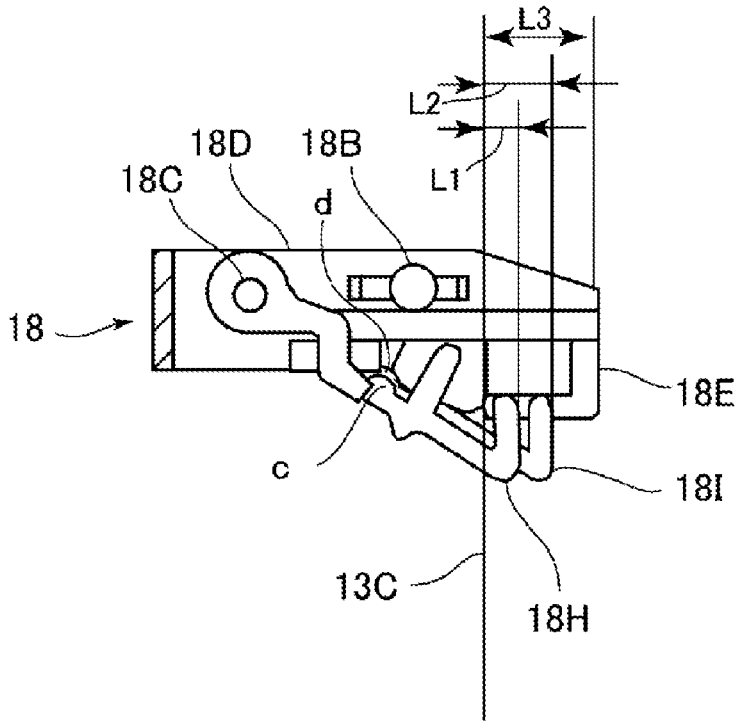
FIGS. 8A and 8B are diagrams illustrating a configuration of a tail end upper face regulating portion which is provided in the tail end regulating plate.
Figure 8B:
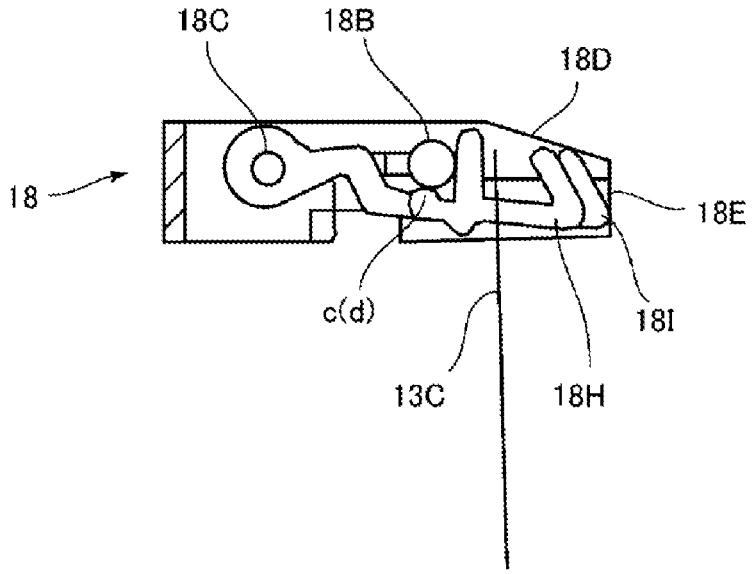

Here, in the embodiment, as illustrated in FIGS. 8A and 8B, the protrusion portion 18D of the tail end upper face regulating portion 18 is provided with two tail end regulating projections 18H and 18I which are stoppers that regulate the movement of the sheet in the direction opposite to the sheet feeding direction and are provided so as to protrude toward the upside of the lifting and lowering platen 12. Furthermore, in the embodiment, two tail end regulating projections are provided, but one or three or more projections may be provided.

The tail end regulating projections 18H and 18I are attached to the support shaft 18B so as to protrude toward the sheet at the lower side of the bottom surface of the protrusion portion 18D of the tail end upper face regulating portion 18 and to be rotatable. Further, the tail end regulating projections 18H and 18I rotate downward by the own weight as illustrated in FIG. 8A until the sheet presses the lower side thereof as the lifting and lowering platen 12 is lifted and respectively move to the positions away from the tail end regulating surface 13C by the distances L1 and L2. Furthermore, the tail end regulating pad 18E is provided so as to protrude from the tail end regulating surface 13C by the distance L3.

FIG. 8B illustrates a state where the lifting and lowering platen 12 is abnormally lifted, and when the lifting and lowering platen 12 is abnormally lifted, the tail end regulating pad 18E is crushed by the lifting and lowering platen 12. Further, the tail end regulating projections 18H and 18I rotate upward until the collision portions c and d which are formed at the center portions of the tail end regulating projections 18H and 18I by the pressing of the lifting and lowering platen 12 collide with the support shaft 18B.

Here, FIG. 5 illustrates a state where the sheet S is normally set on the lifting and lowering platen 12. At this time, the gap ΔL between the tail end regulating surface 13C and the sheet S set on the lifting and lowering platen 12 satisfies the inequation of $\Delta L<L1$. Furthermore, when the inequation of the gap $\Delta L<L1$ is satisfied in this way, the sheet can be smoothly lifted and lowered along the tail end regulating plate 13, and hence this condition does not affect the feeding of the sheet.

In this case, when the lifting of the sheet S starts with the lifting of the lifting and lowering platen 12, two tail end regulating projections 18H and 18I are pressed by the uppermost sheet Sa on the lifting and lowering platen (the tray) so as to be retracted while rotating upward. In addition, when the uppermost sheet Sa contacts the tail end regulating pad 18E, the entire tail end upper face regulating portion 18 is pressed upward by the sheet S.

Then, when the tail end upper face regulating portion 18 is pressed upward so that the tail end sheet face sensor 56 is turned on as described above, the lifting operation of the lifting and lowering platen 12 stops. Next, the sheet feeding operation starts, and loosening air and separating air blow to the sheets, so that the upper sheet is blown up. Here, when the loosening air and the separating air blow in this way, the sheet is retracted until the tail end collides with the regulating surface 18C, but is not substantially retracted since the gap ΔL satisfies the inequation of $\Delta L<L1$. For this reason, the balance between the separating air, the loosening air, and each air flow from the absorption duct is maintained. As a result, the lifting of the sheet S is stabilized, and hence the sheet can be fed without causing a feeding failure or a double feeding.

Figure 9A:
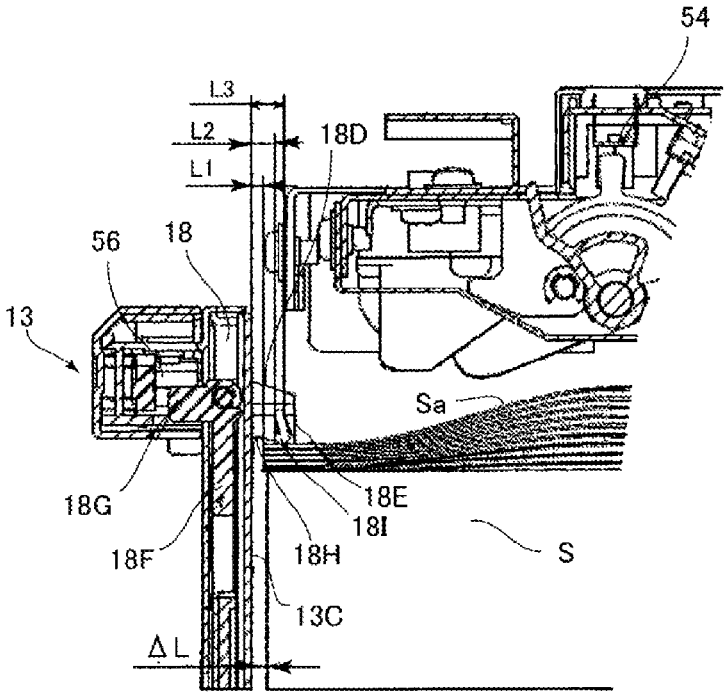
FIGS. 9A and 9B are diagrams illustrating an operation of a tail end regulating projection which is provided in the tail end upper face regulating portion.

On the other hand, FIG. 9A illustrates a case where the gap ΔL between the tail end regulating surface 13C and the sheet S satisfies the inequation of $L1<\Delta L<L2$ when the sheet S is set. In this case, when the lifting of the sheet S starts as the lifting and lowering platen 12 is lifted, the tail end regulating projection 18H close to the tail end regulating surface 13C is present in the gap between the tail end regulating surface 13C and the sheet S. For this reason, only the tail end regulating projection 18I away from the tail end regulating surface 13C is pressed by the uppermost sheet Sa so as to rotate upward. In addition, when the lifting and lowering platen 12 is lifted so that the uppermost sheet Sa contacts the tail end regulating pad 18E, the entire tail end upper face regulating portion 18 is pressed upward. Subsequently, when the tail end sheet face sensor 56 is turned on, the lifting operation of the lifting and lowering platen 12 stops.

Next, the sheet feeding operation starts, and the loosening air and the separating air blow to the sheet so that the upper sheet is blown up. Here, when the loosening air and the separating air blow, the sheet is retracted. However, at this time, since the tail end regulating projection 18H close to the tail end regulating surface 13C does not rotate upward, the tail end of the retracted sheet collides with the tail end regulating projection 18H. As a result, the sheet moves by L2−L1, but since the movement distance is small, the sheet is not substantially retracted. For this reason, the balance between the separating air, the loosening air, and each air flow from the absorption duct is maintained. As a result, the lifting of the sheet S is stabilized, and hence the sheet is fed without causing a feeding failure or a double feeding.

Figure 9B:
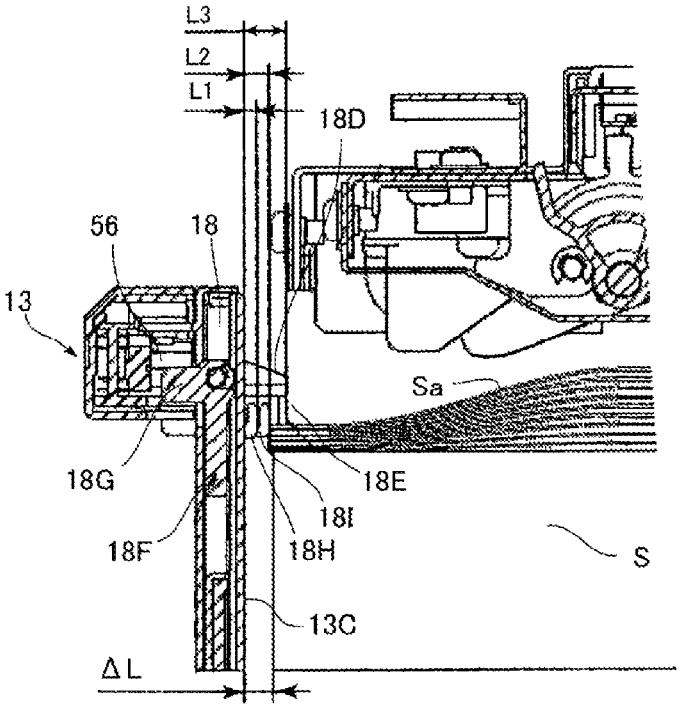

FIG. 9B illustrates a case where the gap ΔL between the tail end regulating surface 13C and the sheet S when the sheet S is set becomes larger and satisfies the inequation of L2<ΔL<L3. In this case, when the lifting of the sheet S starts as the lifting and lowering platen 12 is lifted, the tail end regulating projections 18H and 18I both do not rotate upward since both are present in the gap between the tail end regulating surface 13C and the sheet S. In addition, when the lifting and lowering platen 12 is lifted and the uppermost sheet Sa contacts the tail end regulating pad 18E, the entire tail end upper face regulating portion 18 is pressed upward. Subsequently, when the tail end sheet face sensor 56 is turned on, the lifting operation of the lifting and lowering platen 12 stops.

Next, the sheet feeding operation starts, and the loosening air and the separating air blow to the sheets, so that the upper sheet is blown up. Here, when the loosening air and the separating air blow in this way, the sheet is retracted. However, at this time, since the tail end regulating projections 18I and 18I do not rotate upward, the tail end of the retracted sheet collides with the tail end regulating projection 18I away from the tail end regulating surface 13C. As a result, the sheet moves by L3−L2, but since the movement distance is small, the sheet is not substantially retracted. For this reason, the lifting of the sheet S is stabilized, and hence the sheet is fed without causing a feeding failure or a double feeding.

Furthermore, the gap ΔL between the tail end regulating surface 13C and the sheet S set on the lifting and lowering platen 12 satisfies the inequation of L3<ΔL. In this case, even when the lifting and lowering platen 12 is lifted, the uppermost sheet Sa does not contact the tail end regulating pad 18E and does not press the tail end upper face regulating portion 18 upward. Accordingly, the tail end sheet face sensor 56 is not turned on. However, in this case, the uppermost sheet Sa is detected by the first and second sheet face sensors 54 and 55 of the sheet face detecting mechanism 49. Then, in this case, since the setting position of the tail end regulating plate 13 is not present at the appropriate position, the monitor 300 notifies this fact to the user so that the user sets the tail end regulating plate again. That is, when the gap between the tail end regulating surface 13C and the sheet S is a predetermined distance or more, the monitor 300 as a notifying unit notifies the user so that the user sets the tail end regulating plate again.

As described above, in the embodiment, even when the gap ΔL is formed between the sheet and the regulating surface 18C of the tail end regulating plate 13, it is possible to prevent the sheet which is blown up by the loosening air and the separating air from being retracted by the tail end regulating projections 18H and 18I. Accordingly, since a balance between the separating air, the loosening air, each air flow from the absorption duct is maintained, an absorption failure or a double feeding can be prevented.

That is, in the embodiment, the movement of the sheet S toward the tail end regulating plate 13 is regulated by the tail end regulating projections 18H and 18I which are provided so as to protrude to the gap ΔL. Accordingly, even when a gap is formed between the sheet and the regulating portion, the sheet can be reliably fed.

Here, the air sheet feeding type sheet feeding apparatus has been described so far, but the invention is not limited thereto. The invention may be also applied to the sheet feeding apparatus that adopts a retard sheet feeding type.

Figure 10:
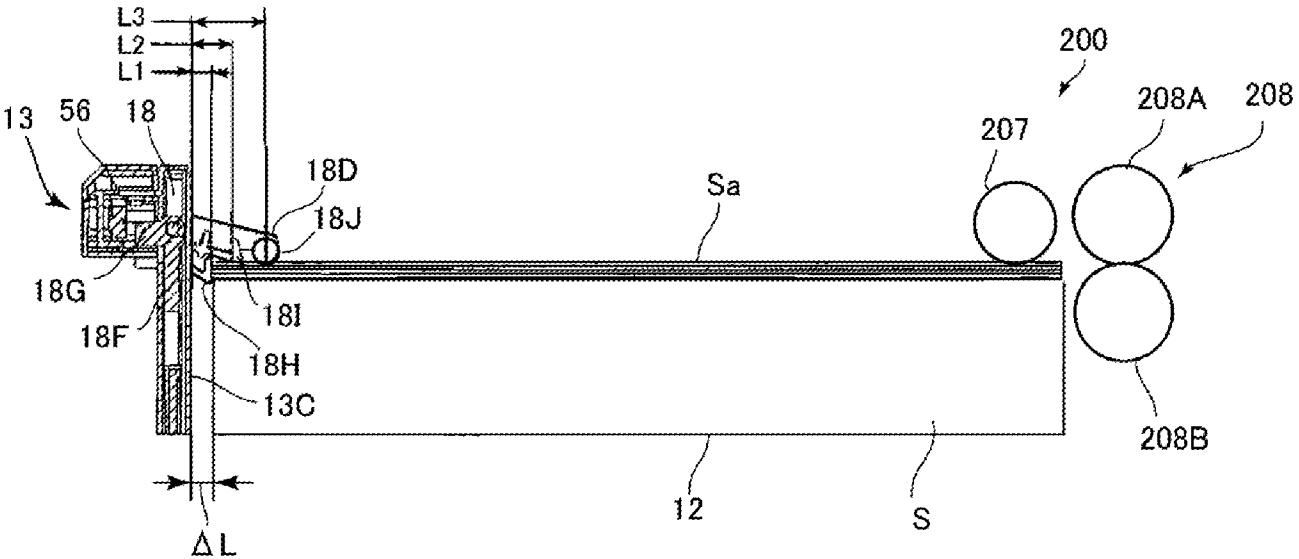
FIG. 10 is a diagram illustrating a configuration of a sheet feeding apparatus according to a second embodiment of the invention.

Next, a second embodiment of the invention that adopts the retard sheet feeding type in this way will be described. FIG. 10 is a diagram illustrating a configuration of a sheet feeding apparatus according to the embodiment. Furthermore, in FIG. 10, the same reference numerals of FIG. 5 indicate the same or corresponding portions.

In FIG. 10, a sheet feeding portion 200 is provided in the sheet feeding apparatus, and the sheet feeding portion 200 includes a pick-up roller 207 which feeds the uppermost sheet Sa of the sheets S on the lifting and lowering platen 12. Further, the sheet feeding portion 200 includes a pair of separating rollers 208 which separates the uppermost sheet Sa and the other sheets when a plurality of sheets is sent by the pick-up roller 207.

Figure 11:
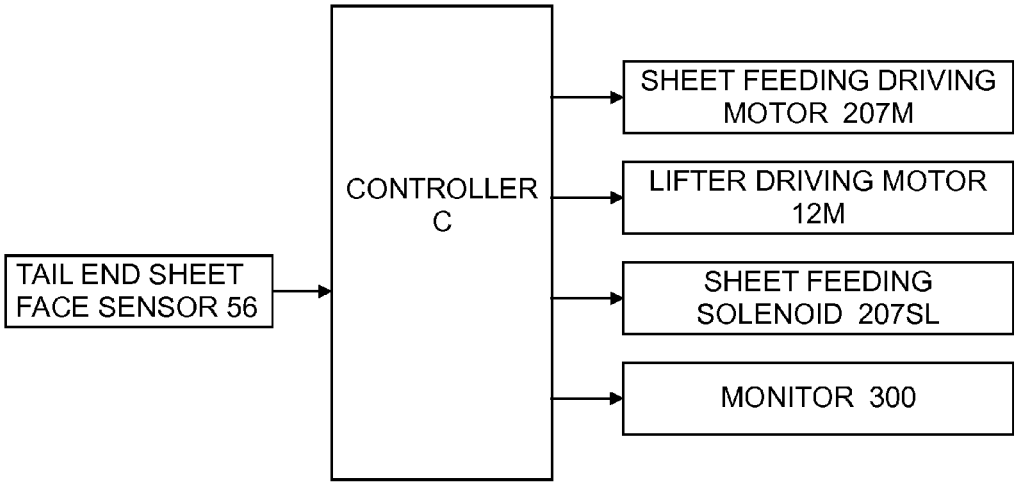
FIG. 11 is a control block diagram illustrating the sheet feeding apparatus.

The pair of separating rollers 208 includes a feeding roller 208A which rotates in the sheet feeding direction and a retarding roller 208B which forms a separation nip portion between the retarding roller and the feeding roller 208A so as to separate the sheets one by one. Here, the retarding roller 208B is provided so as to be rotatable in the direction opposite to the sheet feeding direction, and forms a separation nip portion by pressing the feeding roller 208A. Furthermore, the pick-up roller 207, the feeding roller 208A, and the retarding roller 208B are driven by the sheet feeding driving motor 207M of which the driving operation is controlled by the controller C illustrated in FIG. 11.

Figure 12:
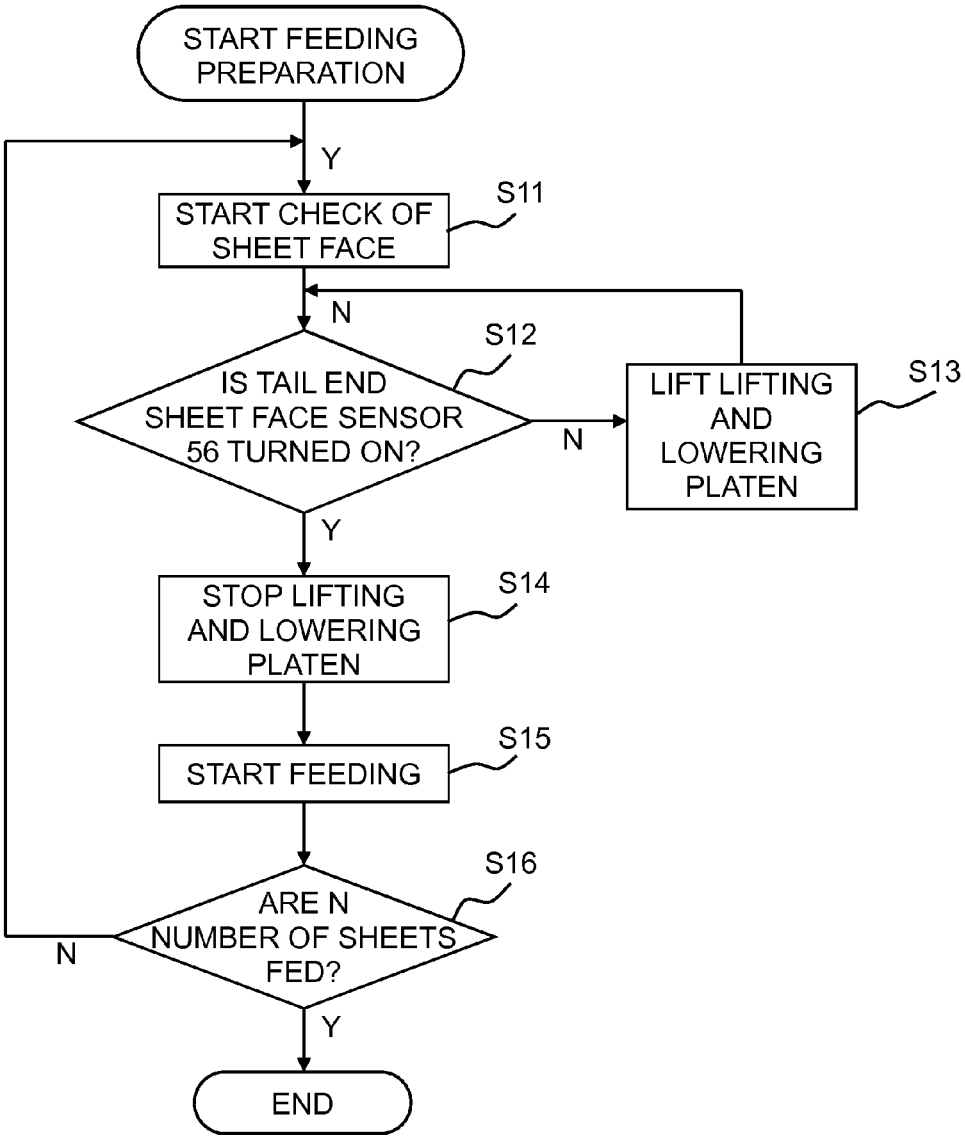
FIG. 12 is a flowchart illustrating an operation of the sheet feeding apparatus.

Next, a control of the sheet feeding operation of the sheet feeding apparatus according to the embodiment will be described by using the flowchart illustrated in FIG. 12. When the controller C receives a sheet feeding signal, the feeding preparation starts, and the lifting and lowering platen 12 is lifted and lowered so as to start the check of the sheet face by the tail end sheet face sensor 56 (S11). Then, when the tail end sheet face sensor 56 is not turned on (N in S12), the lifting and lowering platen 12 is lifted (S13). When the tail end sheet face sensor 56 is turned on (Y in S12), the lifting and lowering platen 12 stops (S14). Subsequently, the feeding of the sheet starts (S15). Furthermore, such a control is repeated until the N-th sheet is fed when N number of sheets are stacked (supported) on the lifting and lowering platen 12, and the feeding operation ends when the N-th sheet is fed (Y in S16).

Here, in the embodiment, when the sheets stacked on the lifting and lowering platen 12 are sent by the pick-up roller 207 in order from the uppermost sheet, only the uppermost sheet is conveyed by the pair of separating rollers 208. However, a plurality of sheets may be sent by the pick-up roller 207 in the sheet feeding direction with a displacement depending on the environment condition or the sheet type. In this case, the plurality of sheets other than the uppermost sheet is conveyed by the pair of separating rollers 208 in the direction opposite to the sheet feeding direction. However, at this time, when a displacement occurs between the sheets, for example, the tail end of the lower sheet may be conveyed until the tail end collides with the tail end regulating plate 13.

Therefore, even in the embodiment, as illustrated in FIG. 10, the protrusion portion 18D of the tail end upper face regulating portion 18 is equipped with the tail end regulating projections 18H and 18I which prevent the sheet from being retracted in the direction opposite to the sheet feeding direction. Furthermore, in the embodiment, a tail end regulating roll 18J is attached to the protrusion portion 18D instead of the tail end regulating pad 18E so that the feeding of the sheet by the pick-up roller 207 is not disturbed.

Here, FIG. 10 illustrates a case where the gap ΔL between the tail end regulating surface 13C and the sheet S when the sheet S is set satisfies the inequation of L1<ΔL<L2. In this case, when the lifting of the sheet S starts as the lifting and lowering platen 12 is lifted, only the tail end regulating projection 18I away from the tail end regulating surface 13C is pressed by the uppermost sheet Sa so as to rotate upward since the tail end regulating projection 18H close to the tail end regulating surface 13C is present in the gap between the tail end regulating surface 13C and the sheet S. In addition, when the uppermost sheet Sa contacts the tail end regulating roll 18J, the entire tail end upper face regulating portion 18 is pressed upward. Subsequently, when the tail end sheet face sensor 56 is turned on, the lifting operation of the lifting and lowering platen 12 stops.

Subsequently, the sheet feeding operation starts, and the sheets stacked on the lifting and lowering platen 12 are sent by the pick-up roller 207 in order from the uppermost sheet. Here, when the plurality of sheets is sent by the pick-up roller 207, the plurality of sheets other than the uppermost sheet is conveyed by the pair of separating rollers 208 in the direction opposite to the sheet feeding direction. At this time, since the tail end regulating projection 18H close to the tail end regulating surface 13C does not rotate upward, the tail end of the retracted sheet collides with the tail end regulating projection 18H. As a result, the sheet moves by L2−L1, but since the movement distance is small, the sheet is not substantially retracted. For this reason, the sheet may be fed without causing a feeding failure.

Furthermore, when the gap ΔL between the tail end regulating surface 13C and the sheet S on the lifting and lowering platen 12 satisfies the inequation of L2<ΔL<L3, the sheet does not abut two tail end regulating projections 18H and 18I even when the sheet on the lifting and lowering platen 12 is lifted. For this reason, the tail ends of the plurality of sheets, conveyed by the pair of separating rollers 208 in the direction opposite to the sheet feeding direction, other than the uppermost sheet collide with the tail end regulating projection 18I away from the tail end regulating surface 13C. As a result, the sheet moves by L3−L2, but since the movement distance is small, the sheet is not substantially retracted. For this reason, the sheet is fed without causing a feeding failure.

In addition, the gap ΔL between the tail end regulating surface 13C and the sheet S set on the lifting and lowering platen 12 may satisfy the inequation of L3<ΔL. In this case, even when the lifting and lowering platen 12 is lifted, the uppermost sheet Sa does not contact the tail end regulating roll 18J and the tail end upper face regulating portion 18 can not be pressed upward. For this reason, the tail end sheet face sensor 56 is not turned on. However, when the tail end sheet face sensor 56 is not turned on even after the lifting of the lifting and lowering platen 12 starts, the monitor 300 notifies the user so that the user sets the tail end regulating plate 13 again.

Further, when the sheet is normally placed so that the gap ΔL between the tail end regulating surface 13C and the sheet S on the lifting and lowering platen 12 satisfies the inequation of ΔL<L1, two tail end regulating projections 18H and 18I are pressed by the uppermost sheet Sa so as to rotate upward as the lifting and lowering platen 12 is lifted. For this reason, the tail ends of the plurality of sheets, conveyed by the pair of separating rollers 208 in the direction opposite to the sheet feeding direction, other than the uppermost sheet are retracted until the tail ends collide with the regulating surface 18C, but are not substantially retracted since the gap ΔL satisfies the inequation of ΔL<L1. For this reason, the sheet can be fed without causing a feeding failure.

As described above, in the embodiment, even when the gap ΔL is formed between the sheet and the regulating surface 18C of the tail end regulating plate 13, the movement of the sheet returned by the retarding roller toward the tail end regulating plate 13 is regulated by the tail end regulating projections 18H and 18I. Accordingly, the sheet can be stably fed.

That is, as in the embodiment, even in the sheet feeding apparatus that adopts the retard sheet feeding type, the movement of the sheet S toward the tail end regulating plate 13 can be regulated by the tail end regulating projections 18H and 18I provided in the gap ΔL. Accordingly, even when the gap ΔL is formed between the sheet and the regulating portion, the sheet can be reliably fed.

Furthermore, in the first and second embodiments described so far, when the tail end upper face regulating portion 18 cannot be pressed upward, it is detected that the gap ΔL between the tail end regulating surface 13C and the sheet S is L3 or more. However, the configuration for detecting that the gap ΔL between the tail end regulating surface 13C and the sheet S is L3 or more is not limited thereto.

Figure 13A:
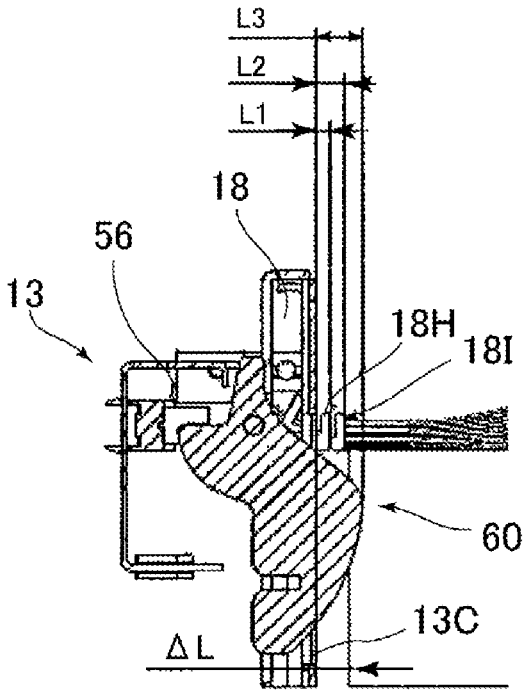
FIGS. 13A and 13B are diagrams illustrating another configuration of a tail end regulating portion of the sheet feeding apparatus.

For example, as illustrated in FIG. 13A, a sensor flag 60 may be rotatably provided in the tail end regulating plate 13 so as to detect that the gap ΔL between the tail end regulating surface 13C and the sheet S is L3 or more. Then, the sensor flag 60 is pressed by the sheet so as to move to a position where the sensor flag is not detected by the tail end sheet face sensor 56 when the gap ΔL is L3 or less and rotates so as to move to a position where the tail end sheet face sensor 56 is turned on when the gap ΔL is L3 or more. Accordingly, since the sensor flag 60 rotates so as to turn on the tail end sheet face sensor 56 when the gap ΔL is L3 or more, it is possible to detect that the gap ΔL is L3 or more.

Figure 13B:
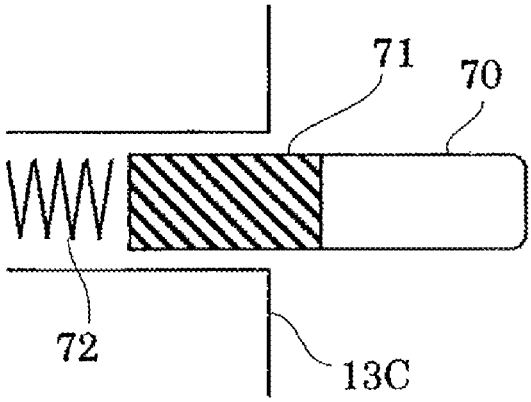
Figure 14A:
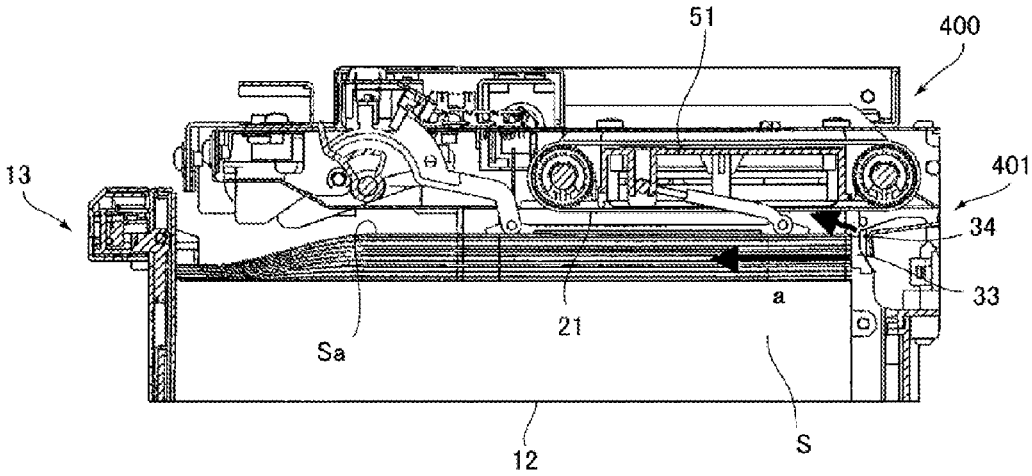
FIG. 14A PRIOR ART
FIGS. 14A and 14B are diagrams illustrating a configuration of a sheet feeding apparatus of the related art.
Figure 14B:
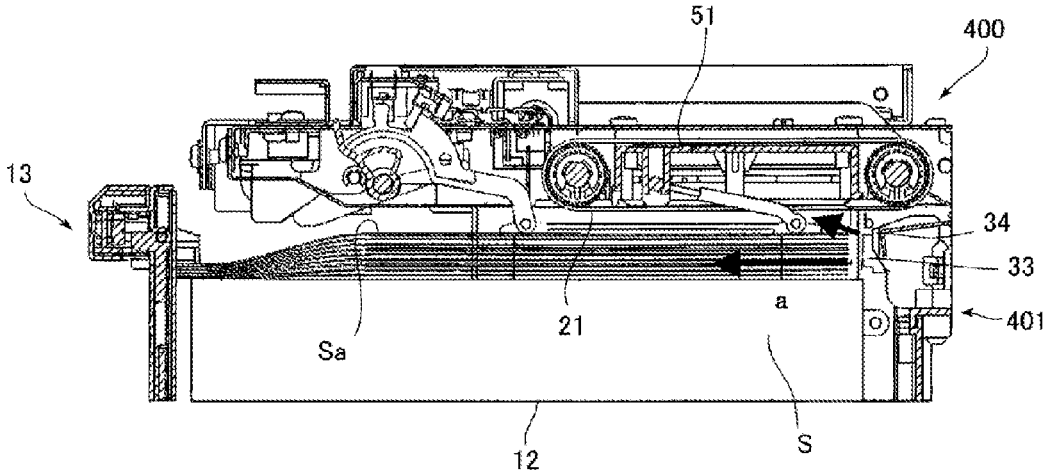
FIG. 14B PRIOR ART

Further, as illustrated in FIG. 13B, a tail end index support rod 70, having a mark 71 detecting that the gap ΔL is L3 or more, may be provided in the tail end regulating plate 13. Then, the tail end index support rod 70 is pressed by the sheet so as to move to a retracting position when the gap ΔL is L3 or less and protrudes by a tail end index spring 72 to a position where the mark 71 is visible when the gap ΔL is L3 or more. Accordingly, since the mark 71 is visible when the gap ΔL is L3 or more, it is possible to directly notify the fact that the gap ΔL is L3 or more to the user.

Further, the sheet feeding apparatuses adopting the air sheet feeding type and the retard sheet feeding type have been described so far, but any sheet feeding type having the same effect may be adopted. Further, a configuration has been described so far in which the tail end regulating projections 18H and 18I are retracted by the upward or downward movement of the lifting and lowering platen 12, but the tail end regulating projections 18H and 18I may be retracted with the upward or downward movement of the tail end upper face regulating portion 18. In addition, the direction in which the tail end regulating projections 18H and 18I are retracted is set as the direction in which the lifting and lowering platen 12 moves, but the retracting direction may be set as any direction when the movement of the sheet can be regulated.

Further, in the description so far, a configuration has been described which prevents the displacement of the sheets by the tail end regulating projections 18H and 18I attached to the tail end regulating plate 13, but the invention is not limited thereto. The invention may be also applied to a side end regulating plate when the same effect may be obtained. For example, with the adopted configuration of the invention, it is possible to prevent the sheet from being displaced to the opposite side end regulating plate by blowing air when the air blows to the side end of the sheet by the side fan.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-240474, filed Nov. 1, 2011, which is hereby incorporated by reference herein in its entirety.

What is claimed is:

1. A sheet feeding apparatus comprising:

a tray which supports a plurality of sheets;

a driving portion which lifts and lowers the tray;

a sheet feeding portion, provided above the tray, configured to feed the sheet supported on the tray lifted by the driving portion;

a rear regulating portion which has a regulating surface against which rear ends of the sheets supported by the tray abut to regulate a movement of the sheets in a direction opposite to a sheet feeding direction of the sheet feeding portion; and a stopper, movably provided for up and down movement on the rear regulating portion, which moves downward to a position in a gap formed between the regulating surface of the rear regulating portion and the sheets on the lifted tray to regulate the movement of rear ends of upper side sheets of the sheets on the lifted tray toward the rear regulating portion in the case of forming the gap between the regulating surface of the rear regulating portion and the rear ends of the sheets and the stopper is retracted upward by an upper face of an uppermost sheet of the sheets on the lifted tray in the case of not forming the gap between the regulating surface of the rear regulating portion and the rear ends of the sheets.

2. The sheet feeding apparatus according to claim 1, wherein the stopper is pressed by the sheet so as to move upward upon abutting the upper face of the uppermost sheet of the sheets supported by the tray when the tray is lifted and the gap is not formed.

3. The sheet feeding apparatus according to claim 1, wherein the rear regulating portion includes an upper face regulating portion which is lifted while abutting a rear end portion of the sheet supported by the tray when the tray is lifted, and the stopper is provided in a downside of a bottom surface of the upper face regulating portion so as to protrude toward the sheets supported by the tray.

4. The sheet feeding apparatus according to claim 1, further comprising:

a sheet sensor which detects the height position of the sheet on the tray lifted by the driving portion after setting the rear regulating portion to the sheet on the tray;

a notifying unit which notifies re-setting of the rear regulating portion; and a controller which causes the notifying unit to notify re-setting of the rear regulating portion when the sheet sensor is not detect the height position of the sheet on the tray.

5. The sheet feeding apparatus according to claim 1, wherein the sheet feeding portion includes an air blowing portion which blows air to the side end of the sheet supported by the tray reaching the feeding position so that the sheet is blown up and an absorption conveying portion which feeds the sheet blown up in an absorbed state, and conveys an uppermost sheet blown up by blowing the air while the sheet is absorbed onto the absorption conveying portion.

6. The sheet feeding apparatus according to claim 1, wherein the sheet feeding portion includes a pick-up roller which sends the sheet supported by the tray, a feeding roller which rotates in a sheet feeding direction, and a retarding roller which is rotatable in a direction opposite to the sheet feeding direction and presses the feeding roller so as to form a separation nip portion between the retarding roller and the feeding roller so that sheets are separated one by one, and separates the sheets one by one by the feeding roller and the retarding roller to feed the sheets fed to the separation nip portion.

7. The sheet feeding apparatus according to claim 1, further comprising:

a second stopper which has a second regulation portion to regulate the rear ends of the upper side sheets, wherein a distance between the regulating surface and the second regulation portion is different from a distance between the regulating surface and a first regulation portion of the stopper to regulate the rear ends of the upper side sheets.

8. An image forming apparatus comprising:

a tray which supports a plurality of sheets;

a driving portion which lifts and lowers the tray;

a sheet feeding portion, provided above the tray, configured to feed the sheet supported on the tray lifted by the driving portion;

a rear regulating portion which has a regulating surface being abutted by rear ends of the sheets supported by the tray to regulate a movement of the sheets in a direction opposite to a sheet feeding direction of the sheet feeding portion;

a stopper, movably provided for up and down movement on the rear regulating portion, which moves downward to position in a gap formed between the regulating surface of the rear regulating portion and the sheets on the lifted tray to regulate the movement of rear ends of upper side sheets of the sheets on the lifted tray toward the rear regulating portion in the case of forming the gap between the regulating surface of the regulating portion and the rear ends of the sheets and the stopper is retracted upward by an upper face of an uppermost sheet of the sheets on the lifted tray in the case of not forming the gap between the regulating surface of the rear regulating portion and the rear ends of the sheets; and an image forming portion which forms an image on the sheet fed from the sheet feeding apparatus.

9. The image forming apparatus according to claim 8, wherein the stopper is pressed by the sheet so as to move upward upon abutting the upper face of the uppermost sheet of the sheets supported by the tray when the tray is lifted and the gap is not formed.

10. The image forming apparatus according to claim 8, wherein the rear regulating portion includes an upper face regulating portion which is lifted while abutting a rear end portion of the sheet supported by the tray when the tray is lifted, and the stopper is provided in a downside of a bottom surface of the upper face regulating portion so as to protrude toward the sheets supported by the tray.

11. The image forming apparatus according to claim 8, further comprising:

a sheet sensor which detects the height position of the sheet on the tray lifted by the driving portion after setting the rear regulating portion to the sheet on the tray;

a notifying unit which notifies re-setting of the rear regulating portion; and a controller which causes the notifying unit to notify re-setting of the rear regulating portion when the sheet sensor is not detect the height position of the sheet on the tray.

12. The image forming apparatus according to claim 8, wherein the sheet feeding portion includes an air blowing portion which blows air to the side end of the sheet supported by the tray reaching the feeding position so that the sheet is blown up and an absorption conveying portion which feeds the sheet blown up in an absorbed state, and conveys an uppermost sheet blown up by blowing the air while the sheet is absorbed onto the absorption conveying portion.

13. The image forming apparatus according to claim 8, wherein the sheet feeding portion includes a pick-up roller which sends the sheet supported by the tray, a feeding roller which rotates in a sheet feeding direction, and a retarding roller which is rotatable in a direction opposite to the sheet feeding direction and presses the feeding roller so as to form a separation nip portion between the retarding roller and the feeding roller so that sheets are separated one by one, and separates the sheets one by one by the feeding roller and the retarding roller to feed the sheets fed to the separation nip portion.

14. The image forming apparatus according to claim 8, further comprising:

a second stopper which has a second regulation portion to regulate the rear ends of the upper side sheets, wherein a distance between the regulating surface and the second regulation portion is different from a distance between the regulating surface and a first regulation portion of the stopper to regulate the rear ends of the upper side sheets.

* * * * *